US006439475B1

(12) United States Patent
Kloepfer et al.

(10) Patent No.: US 6,439,475 B1
(45) Date of Patent: Aug. 27, 2002

(54) HIGH-PRESSURE CLEANING APPARATUS

(75) Inventors: Juergen Kloepfer, Burgstetten; Markus Wurster, Winnenden, both of (DE)

(73) Assignee: Alfred Kaercher GmbH & Co., Winnenden (DE)

( * ) Notice: Subject to any disclaimer, the term of this patent is extended or adjusted under 35 U.S.C. 154(b) by 0 days.

(21) Appl. No.: 09/710,773

(22) Filed: Nov. 10, 2000

Related U.S. Application Data

(63) Continuation of application No. PCT/EP99/01295, filed on Feb. 27, 1999.

(30) Foreign Application Priority Data

May 26, 1998 (DE) ..... 298 09 473 U

(51) Int. Cl.[7] ..... B65H 75/00

(52) U.S. Cl. ..... 239/198; 239/195; 239/197; 242/403.1

(58) Field of Search ..... 239/195–198, 239/722, 146, 147, 158; 242/399, 400, 400.1, 403, 405, 403.1; 137/355.26; 248/90

(56) References Cited

U.S. PATENT DOCUMENTS

| | | | | | |
|---|---|---|---|---|---|
| 2,397,267 A | * | 3/1946 | Jauch et al. | ..... | 222/25 |
| 4,007,876 A | * | 2/1977 | Stevenson | ..... | 239/318 |
| 4,144,898 A | * | 3/1979 | Guignon et al. | ..... | 239/197 |
| 4,810,169 A | | 3/1989 | Kränzle | | |
| 4,967,960 A | * | 11/1990 | Futrell | ..... | 239/148 |
| 5,029,758 A | * | 7/1991 | Chayer | ..... | 239/172 |
| 5,303,866 A | * | 4/1994 | Hawks, Jr. | ..... | 239/197 |
| 5,816,499 A | * | 10/1998 | Christiansen | ..... | 239/198 |
| 6,279,838 B1 | * | 8/2001 | Sivells et al. | ..... | 239/146 |

FOREIGN PATENT DOCUMENTS

| | | |
|---|---|---|
| DE | 39 40 543 | 6/1991 |
| DE | 41 19 907 | 12/1992 |
| DE | 94 08 706 | 9/1994 |
| DE | 297 17 390 | 2/1998 |
| EP | 0 438 680 | 7/1991 |
| EP | 0 770 575 | 5/1997 |

* cited by examiner

*Primary Examiner*—Lesley D. Morris
*Assistant Examiner*—Dinh Q. Nguyen
(74) *Attorney, Agent, or Firm*—Barry R. Lipsitz

(57) ABSTRACT

In order to so construct a high-pressure cleaning apparatus with a motor pump unit, in which a high-pressure pump is arranged so as to adjoin a motor in the direction of the motor shaft of the motor, and with a hose drum for a high-pressure hose which connects the pressure outlet of the high-pressure pump to a liquid dispensing device, that a favorable arrangement of the hose drum is possible with a particularly simple structure, it is proposed that the axis of rotation of the hose drum extend transversely to the direction of the motor shaft and be arranged in the area of the high-pressure pump, and that the hose drum be arranged at the side of and next to the motor pump unit.

11 Claims, 1 Drawing Sheet

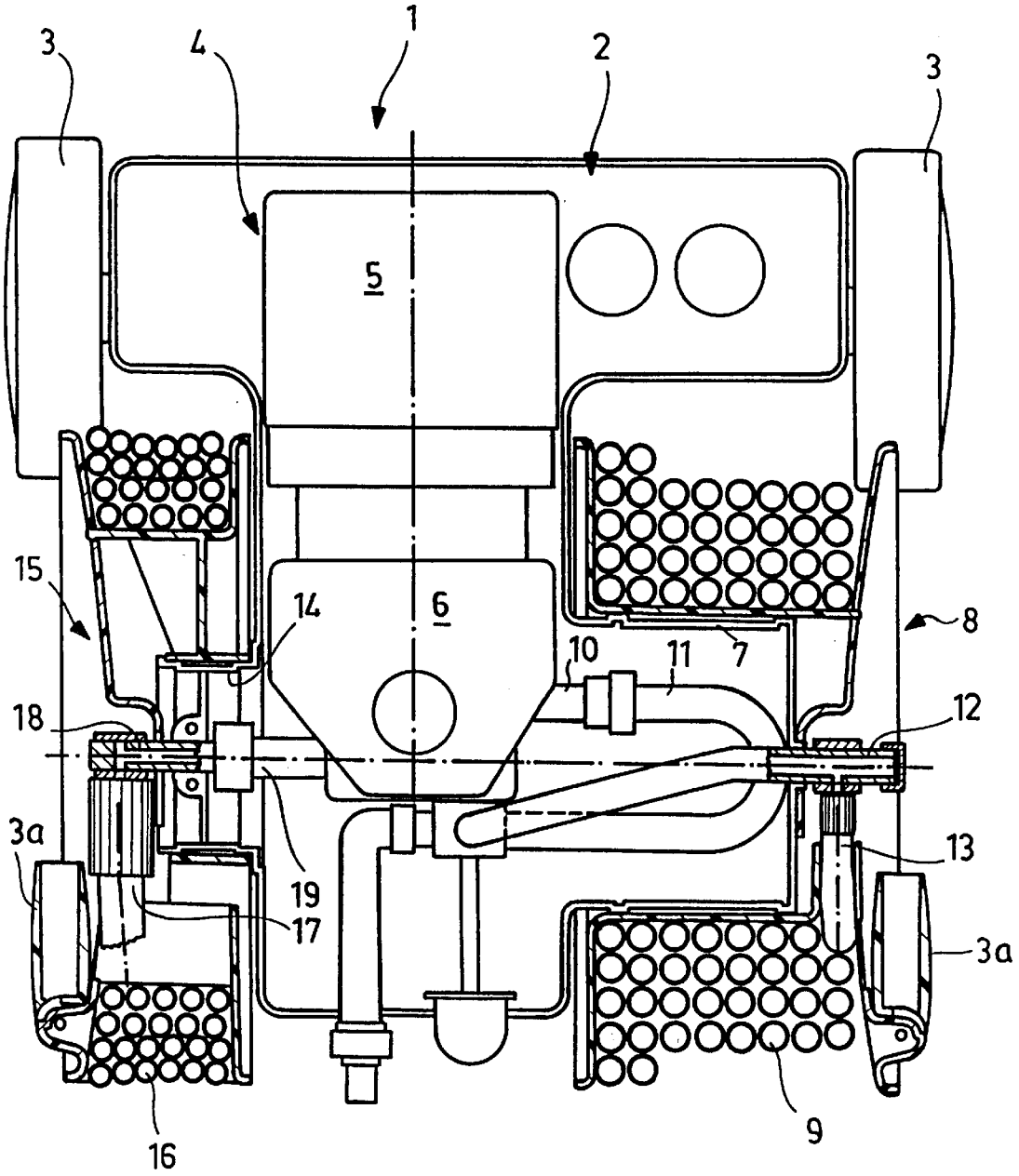
1
2
3
3
4
5
6
7
8
9
10
11
12
13
14
15
16
17
18
19
3a
3a

HIGH-PRESSURE CLEANING APPARATUS

The present invention is a continuation and relates to the subject matter disclosed in international application PCT/EP 99/01295 of Feb. 27, 1999, the entire specification of which is incorporated herein by reference.

The invention relates to a high-pressure cleaning apparatus with a motor pump unit, in which a high-pressure pump is arranged so as to adjoin a motor in the direction of the motor shaft of the motor, and with a hose drum for a high-pressure hose which connects the pressure outlet of the high-pressure pump to a liquid dispensing device, with the axis of rotation of the hose drum extending transversely to the direction of the motor shaft.

A high-pressure cleaning apparatus is known from DE 39 40 543 A1, wherein the motor pump unit is arranged inside a hose drum, which results in a relatively complicated structure as several rotatable connections are required. In a high-pressure cleaning apparatus of the kind described at the outset (EP 0 770 575 A1) the hose drum is arranged below the motor pump unit, which results in a large structural height in this high-pressure cleaning apparatus. Moreover, the distribution of weight is unfavorable as the very heavy motor pump unit is arranged at a relatively large distance from the undercarriage of the high-pressure cleaning apparatus.

The object of the invention is to so construct a generic high-pressure cleaning apparatus that a favorable arrangement of the hose drum is possible with a particularly simple structure.

This object is accomplished with a high-pressure cleaning apparatus of the kind described at the outset, in accordance with the invention, in that the axis of rotation of the hose drum runs through the motor pump unit so that the hose drum is arranged at the side of and next to the motor pump unit.

A very compact arrangement wherein the hose drum is arranged at the side of and next to the motor pump unit is thereby obtained and results in a balanced weight ratio for the high-pressure cleaning apparatus. Owing to the mounting of the hose drum in the area of the high-pressure pump, a particularly short distance between high-pressure pump and hose drum is obtained, which is structurally easy to bridge, and it is adequate to connect the hose drum in a manner known per se via a rotatable connection to the high-pressure pump outlet on the pressure side.

It is expedient for the axis of rotation of the hose drum to extend parallel to the pressure outlet of the high-pressure pump.

In particular, provision may be made for the axis of rotation of the hose drum to extend coaxially with the pressure outlet of the high-pressure pump. In this embodiment, it is then also particularly advantageous for the pressure outlet of the high-pressure pump to form a bearing shaft for the hose drum so that in all a particularly compact structure results.

In a further embodiment, provision may be made for a hose or cable drum to be arranged on the side of the motor pump unit opposite the hose drum, with the hose or cable drum being rotatable about an axis of rotation extending parallel to the axis of rotation of the hose drum. Such a second hose drum on the opposite side of the motor pump unit likewise results in a very well-balanced weight behavior of the apparatus, and, in addition, the two drums can then be arranged very expediently in the immediate vicinity of the motor pump unit.

The further drum can be either a hose drum, for example, for a hose for supplying the high-pressure pump on the suction side or a cable drum, for example, for supplying the motor electrically.

It is expedient for the axes of rotation of the hose drum and the further hose or cable drum to coincide.

Here, too, provision may be made for a suction inlet of the high-pressure pump to form a bearing shaft for the hose or cable drum.

An arrangement wherein the axes of rotation of the hose drum and of the hose or cable drum, if provided, are arranged parallel to axes of rotation of wheels of the high-pressure cleaning apparatus is particularly expedient. In particular, the axes of rotation of the drums can be arranged between front and rear wheels or between wheels and supports of the high-pressure cleaning apparatus.

The following description of a preferred embodiment of the invention serves in conjunction with the drawing the purpose of further explanation. The drawing shows a schematic plan view of a high-pressure cleaning apparatus with two drums shown in sectional representation.

The high-pressure cleaning apparatus 1 shown in the drawing comprises an undercarriage 2 with wheels 3, which are rotatable about parallel axes of rotation, and with supports 3*a*.

A motor pump unit 4 with an electric motor 5 and a high-pressure pump 6 is mounted on the undercarriage at approximately the center thereof. The motor shaft of the electric motor 5 extends at right angles to the axes of rotation of the wheels 3 in a horizontal plane, i.e., parallel to the longitudinal direction of the high-pressure cleaning apparatus. The high-pressure pump 6 adjoins the electric motor 5 in the direction of the motor shaft and is arranged so as to be located approximately at the center of the undercarriage 2.

A high-pressure hose 16 is wound onto a hose drum 15 which is rotatably mounted on a cylindrical bearing stud 14 and arranged at one side of the motor pump unit 4. The axis of rotation of the hose drum 15 extends parallel to the axes of rotation of the wheels 3 and hence at right angles to the motor shaft. It is arranged in the area of the high-pressure pump 6. A pressure outlet 19 of the high-pressure pump 6 projects with a pipe connection piece 18 into the interior of the bearing stud 14 and forms a liquid connection with the radially downwardly extending end 17 of the high-pressure hose 16.

At the opposite side of the motor pump unit 4, a second hose drum 8 is mounted on a further bearing stud 7 for rotation about an axis of rotation which extends coaxially with the axis of rotation of the hose drum 15. A flexible hose 9 is wound onto this hose drum 8, and its end 13 forms a liquid-tight connection with a pipe connection piece 12, which is arranged coaxially with the axis of rotation of the hose drum 8 and is connected via a pipeline 11 to the suction inlet 10 of the high-pressure pump 6.

Hence the axes of rotation of the two hose drums 8 and 15 are located approximately half-way between the axes of rotation of the wheels 3, on the one hand, and the supports 3*a*, on the other hand. Owing to the central arrangement of the motor pump unit 4 and the arrangement of two hose drums 8 and 15 at the sides a compact arrangement with uniform distribution of weight is obtained. This results in short connection paths and in the connections to the pump connections being easy to make.

What is claimed is:

1. High-pressure cleaning apparatus with a motor pump unit, in which a high-pressure pump is arranged so as to adjoin a motor in the direction of a motor shaft of the motor, and with a hose drum for a high-pressure hose which connects a pressure outlet of the high-pressure pump to a liquid dispensing device, with an axis of rotation of the hose drum extending transversely to the direction of the motor shaft, wherein the axis of rotation of the hose drum extends through the motor pump unit so that the hose drum is arranged at the side of and next to the motor pump unit.

2. High-pressure cleaning apparatus as defined in claim 1, wherein the axis of rotation of the hose drum extends parallel to the pressure outlet of the high-pressure pump.

3. High-pressure cleaning apparatus as defined in claim 2, wherein the axis of rotation of the hose drum extends coaxially with the pressure outlet of the high-pressure pump.

4. High-pressure cleaning apparatus as defined in claim 3, wherein the pressure outlet of the high-pressure pump forms a bearing shaft for the hose drum.

5. High-pressure cleaning apparatus as defined in claim 1, wherein a hose or cable drum is arranged on the side of the motor pump unit opposite the hose drum, said hose or cable drum being rotatable about an axis of rotation extending parallel to the axis of rotation of the hose drum.

6. High-pressure cleaning apparatus as defined in claim 5, wherein the axes of rotation of the hose drum and the hose or cable drum coincide.

7. High-pressure cleaning apparatus as defined in claim 6, wherein a suction inlet of the high pressure pump forms a bearing shaft for the hose or cable drum.

8. High-pressure cleaning apparatus as defined in claim 5, wherein the axes of rotation of the hose drum and of the hose or cable drum, if provided, are arranged parallel to axes of rotation of wheels of the high-pressure cleaning apparatus.

9. High-pressure cleaning apparatus as defined in claim 8, wherein the axes of rotation of the hose drum and of the hose or cable drum, if provided, are arranged between front wheels and supports or rear wheels of the high-pressure cleaning apparatus.

10. High-pressure cleaning apparatus as defined in claim 1, wherein the axis of rotation of the hose drum and an axis of rotation of a hose or cable drum, if provided, are both arranged parallel to axes of rotation of wheels of the high-pressure cleaning apparatus.

11. High-pressure cleaning apparatus as defined in claim 10, wherein the axes of rotation of the hose drum and of the hose or cable drum, if provided, are arranged between front wheels and supports or rear wheels of the high-pressure cleaning apparatus.

* * * * *